US006834491B2

(12) United States Patent
Coppola

(10) Patent No.: US 6,834,491 B2
(45) Date of Patent: Dec. 28, 2004

(54) FLAME-PASSAGE DEVICE FOR NON-ANNULAR GAS TURBINE COMBUSTION CHAMBERS

(75) Inventor: Alessandro Coppola, Prato (IT)

(73) Assignee: Nuovo Pignone Holding S.p.A., Florence (IT)

( * ) Notice: Subject to any disclaimer, the term of this patent is extended or adjusted under 35 U.S.C. 154(b) by 0 days.

(21) Appl. No.: 10/296,709

(22) PCT Filed: May 18, 2001

(86) PCT No.: PCT/EP01/05790

§ 371 (c)(1),
(2), (4) Date: Mar. 28, 2003

(87) PCT Pub. No.: WO01/92787

PCT Pub. Date: Dec. 6, 2001

(65) Prior Publication Data

US 2004/0098990 A1 May 27, 2004

(30) Foreign Application Priority Data

Jun. 2, 2000 (IT) ..... MI2000A1241

(51) Int. Cl.[7] ..... F02C 3/00; F02C 7/20
(52) U.S. Cl. ..... 60/39.37; 60/798; 60/800
(58) Field of Search ..... 60/798, 39.37, 60/800

(56) References Cited

U.S. PATENT DOCUMENTS

| | | | | | |
|---|---|---|---|---|---|
| 2,832,195 | A | * | 4/1958 | Weissborn, Jr. | 60/39.37 |
| 4,249,372 | A | * | 2/1981 | White | 60/796 |
| 5,154,049 | A | * | 10/1992 | Ford et al. | 60/796 |
| 5,402,635 | A | | 4/1995 | Smith et al. | |
| 5,896,742 | A | * | 4/1999 | Black et al. | 60/39.37 |
| 6,220,015 | B1 | * | 4/2001 | Mina | 60/39.37 |

FOREIGN PATENT DOCUMENTS

| | | |
|---|---|---|
| EP | 0 466 465 A | 1/1992 |
| EP | 0 866 274 A | 9/1998 |
| EP | 0 919 774 A | 6/1999 |
| EP | 0 972 993 A | 1/2000 |

* cited by examiner

*Primary Examiner*—Charles G. Freay
(74) *Attorney, Agent, or Firm*—Nixon & Vanderhye

(57) ABSTRACT

A flame-passage device (10) for non-annular gas turbine combustion chambers comprises a tubular body (11), which is provided with a plurality of cooling holes (12), for cooling on the swirl-cooling type. The tubular body (11) is inserted in a flanged pipe (27), which connects the cases (31, 32) of two successive combustion chambers (17, 18), and has a first end (13) with a cylindrical shape, and a second end (14) with an oval shape, wherein the second, oval end (14) is provided with three rings (23, 24, 25), for anchorage of the corresponding combustion chamber (17) to the case (31).

9 Claims, 3 Drawing Sheets

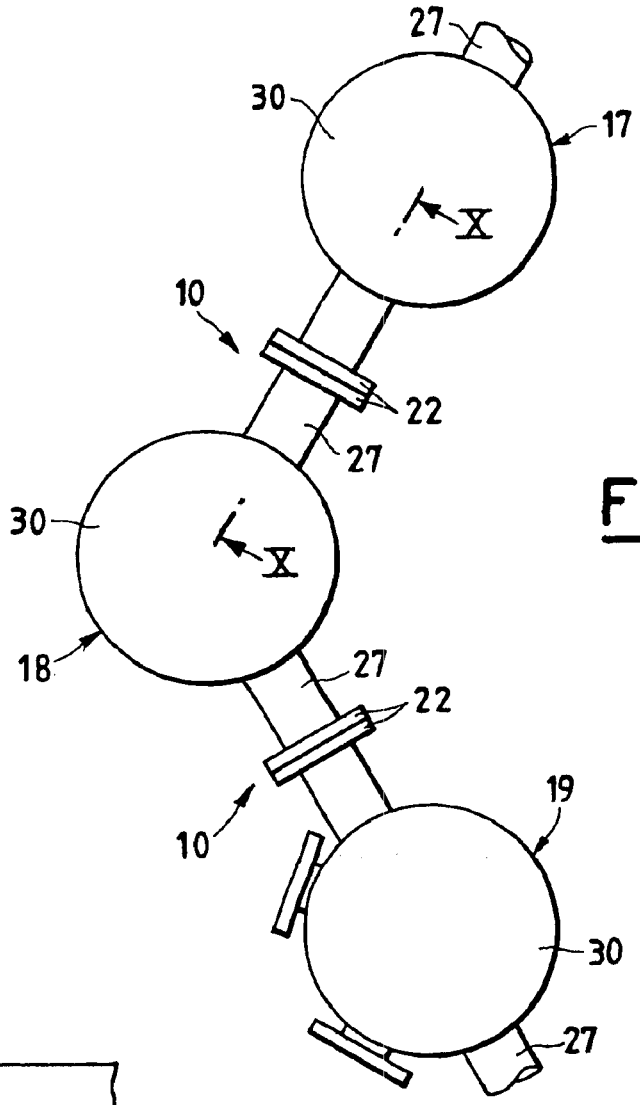
Fig.7
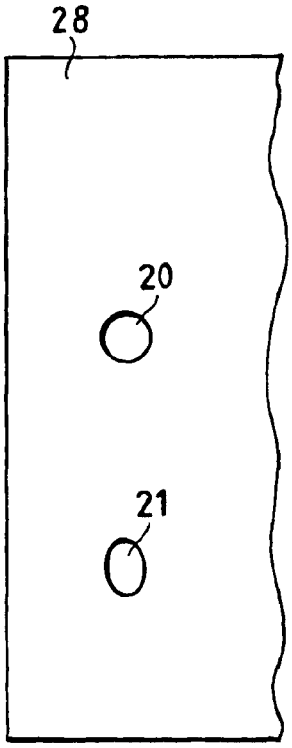
Fig.8
Fig.9
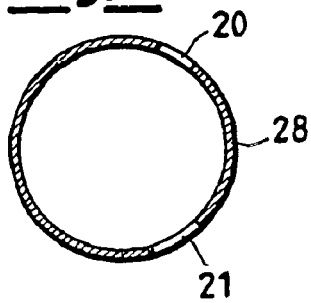

FLAME-PASSAGE DEVICE FOR NON-ANNULAR GAS TURBINE COMBUSTION CHAMBERS

This application is the US national phase of international application PCT/EP01/05790 filed 18 May 2001, which designated the US.

BACKGROUND OF THE INVENTION

The present invention relates to a flame-passage device for non-annular gas turbine combustion chambers.

The constant quest for increases in the performance levels of gas turbines, and in the intervals between the various stoppages for maintenance, as well as the pressing need to reduce pollutant emissions as far as possible, makes necessary optimisation of all the components which are inserted in the so-called hot gas path.

In particular, the combustion system, which acts as an energiser for the thermal-carrier fluid, is the true heart of the turbine engine, and therefore defines its level of emission, and, according to the service life of its own components, the intervals of functioning between machine stoppages, in order to carry out inspections of the combustion chambers.

The requirement to develop the machines in operation, with increases in the compression ratios and fire temperatures, are a further reason for emphasising the criticality of the hot components.

Reduction of the emissions, with an increase in the service life of the components, and optionally also in the efficiency of the system, also constitutes a general target which undoubtedly has an impact on the clientele of heavy duty machines, and is a stimulating technological challenge for the designers.

In particular, in the case of machines which have had a certain length of service, it is possible to gather sufficient statistical data to determine the parameters and details which are critical in achieving overall improvements, such as to justify the cost of the design and subsequent marketing, optionally in uprate packages for the aftermarket.

A major technical problem therefore consists substantially of determining solutions which permit achievement of maximum satisfaction of the client for the three aforementioned aspects, all by means of innovative creations which are economically acceptable.

In order better to understand the technical problems which are involved in the present invention, at this point reference is made to the following state of the art.

The solutions which are currently used in order to achieve the three above-described objectives (greater efficiency, longer service life of the machine, and fewer pollutant emissions), are not in general combined in a single product, but are on the other hand implemented in ranges of alternative components.

In order to increase the service life, and thus the intervals of inspection of the combustion chambers, use is made of materials, such as stellite 6, deposited onto elements which may become worn by relative vibratory motion, super-alloys with a nickel/cobalt base, with high levels of mechanical characteristics and of resistance to corrosion at high temperatures, additions of a ceramic type, to reduce the temperatures of the metal (for the same cooling flows), and optimisation of the design of the components, on the basis of experience acquired.

A previous solution, consisting of six combustion chambers arranged in two rows of three parallel combustion chambers stacked on both sides of the machine, in an arrangement at right-angles to the machine axis, by means of interposition of 90° connection elbows between the liners and transition pieces, was then replaced by an arrangement characterised by chambers inclined by only a few degrees in relation to the machine axis, and insertion of the liners directly in the transition piece, and therefore without the need for further connection elements.

Particular problems of the known art also become apparent by taking into consideration the operations of fitting and removal of the various components.

In the conventional case, the procedure followed consists of opening the covers of the chambers including burners, removing one of the liners of the chambers which are connected to the adjacent chambers by means of a single flame-passage tube, then removing the entire flame-passage unit from the flanged pipe which connects the two cases of the said chambers, such that the case of the said chambers has its liner removed, and the subsequent chamber is also connected at this point only by the flame-passage tube, for connection to the successive chamber.

The procedure continues iteratively, with removal of all the liners and the corresponding crossfires.

Since at this point the crossfires have been removed, the flanged pipes outside the latter are free to be disconnected, thus permitting removal also of the individual cases.

However, the complexity and intricacy of this succession of removal operations should be noted.

In particular, the arrangement of the combustion chambers in the gap between the flanging on the turbine case, and the pipe to supply induction air to the compressor (which is further limited in the lower area by the presence of the front support fork of the machine), makes it impossible to fit and remove the combustion chambers according to the method currently used for all the multi-canned applications.

BRIEF SUMMARY OF THE PRESENT INVENTION

The object of the present invention is thus to provide a flame-passage device for non-annular gas turbine combustion chambers, comprising a combustion system which is innovative both from the point of view of the overall arrangement, and from that of its component elements.

A further object of the invention is to provide a flame-passage device for non-annular gas turbine combustion chambers, which is designed particularly for the aftermarket, and is therefore easy to fit and remove.

Another object of the invention is to provide a flame-passage device for non-annular gas turbine combustion chambers, which has a high level of efficiency and mechanical reliability.

These and other objects are achieved by a flame-passage device for non-annular gas turbine combustion chambers, of the type comprising a tubular body, which is provided with a plurality of cooling holes, for cooling of the swirl-cooling type, wherein the said tubular body is inserted in a flanged pipe, which connects the cases of two successive combustion chambers, characterised in that it has a first end with a cylindrical shape, and a second end with an oval shape, wherein the second, oval end is provided with three rings, for anchorage of the corresponding combustion chamber to the case.

According to a preferred embodiment of the present invention, a cylindrical collar can be fitted at the said first, cylindrical end of the said tubular body, and an oval collar can be fitted at the said second, oval end of the said tubular body.

According to another preferred embodiment of the present invention, the cases which belong to each combustion chamber each have a circular hole, for connection to the cylindrical end of the said flame-passage, tube, which takes place by means of interposition of the said cylindrical collar, and the cases of each combustion chamber each have an oval hole, for connection to the oval end of the said flame-passage tube, which takes place by means of interposition of the said oval collar.

According to another preferred embodiment of the present invention, the three rings, which are present at the said second, oval end, permit anchorage of the corresponding combustion chamber to the case, by means of use of a corresponding fork.

According to a further preferred embodiment of the present invention, on the ends of the said flame-passage tube, an anti-wear deposit made of stellite 6 or another hard material is provided, in order to cover the contact surface in the interface with the said collars of the liners.

In addition, the flame-passage tube can be translated along almost the entire length inside a liner body, thus releasing immediately the connection flanging between the various cases of the combustion chambers.

Further characteristics of the invention are defined in the claims attached to the present patent application.

BRIEF DESCRIPTION OF THE DRAWING FIGURES

Further objects and advantages of the present invention, as well as its structural and functional characteristics, will become apparent by examining the following description and the drawings attached to it, which are provided purely by way of non-limiting, explanatory example, and in which:

FIG. 7 represents a plan view of some combustion chambers which belong to a non-annular gas turbine, and are connected by the flame-passage device according to the invention;

FIG. 8 represents the development of the liner of one of the combustion chambers in FIG. 7;

FIG. 9 represents in cross-section one of the combustion chambers in FIG. 7; and finally.

DETAILED DESCRIPTION OF A PREFERRED EMBODIMENT

Figure 2:
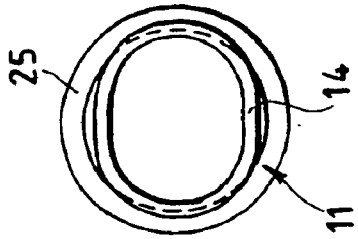
FIG. 2 represents a plan view of the flame-passage tube in FIG. 1.
Figure 1:
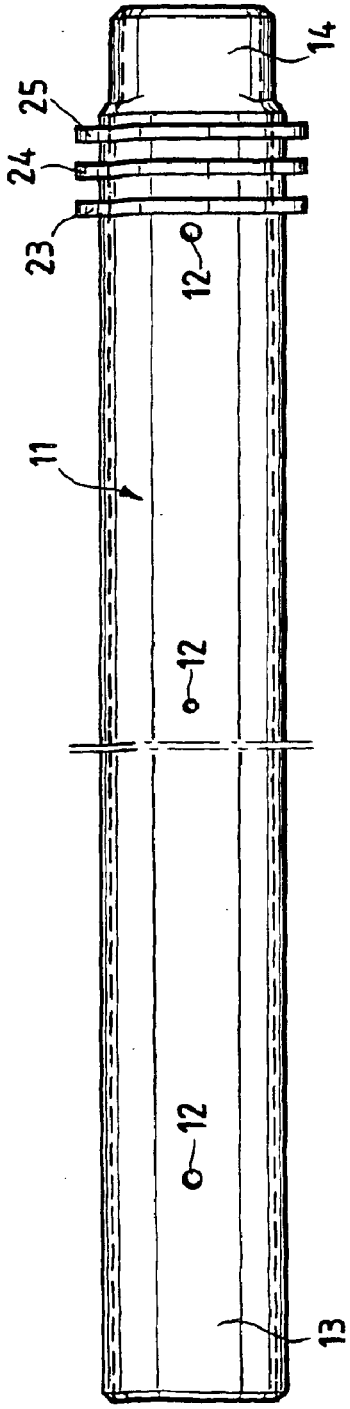
FIG. 1 represents a lateral view of a flame-passage tube for non-annular gas turbine combustion chambers, according to the present invention.

With particular reference to the aforementioned figures, the flame-passage device for non-annular gas turbine combustion chambers, according to the present invention, is indicated globally by the numerical reference 10.

The flame-passage device 10 consists of a tubular body 11, which is provided with a plurality of cooling holes 12, for cooling of the swirl cooling type.

The flame-passage tube 10 has a first end 13, which has a cylindrical shape, and a second end 14, which has an oval shape.

Figure 6:
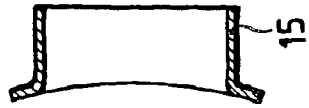
FIG. 6 represents a view in cross-section according to the plane VI—VI, of the cylindrical collar in FIG. 5.
Figure 5:
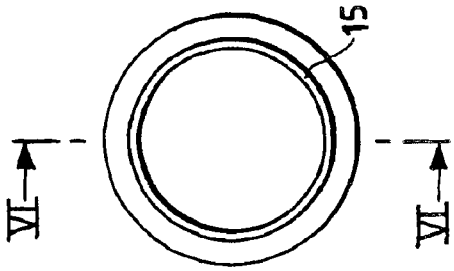
FIG. 5 represents a plan view of a cylindrical collar, to be fitted to the flame-passage tube in FIG. 1.
Figure 4:
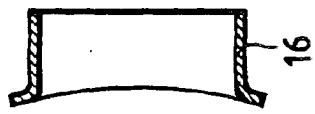
FIG. 4 represents a view in cross-section, according to the plane IV—IV, of the oval collar in FIG. 3.
Figure 3:
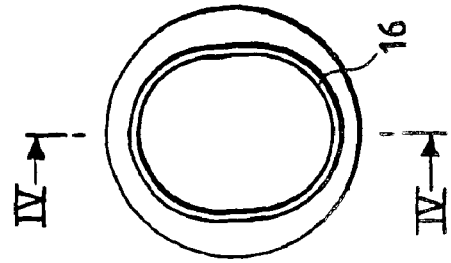
FIG. 3 represents a plan view of an oval collar, to be fitted to the flame-passage tube in FIG. 1.

At this first end 13, there can be fitted a cylindrical collar 15, which is represented in FIGS. 5–6, whereas at the said second end 14, there can be fitted an oval collar 16, which is represented in FIGS. 3–4.

FIG. 7 shows some combustion chambers 17, 18 and 19, which belong to a non-annular gas turbine, each of which is connected to the next chamber by one of the flame-passage devices 10 according to the invention.

The device 10 thus fulfils the requirements of integration with the other elements of the combustion system.

The flame-passage tube 10 can be translated along almost all of its own length inside a liner body, thus releasing immediately the connection flanging 22 between the various cases 31, 32, relative to the combustion chambers 17, 18, and 19.

FIG. 8 represents the development of the liner 28 of one of the combustion chambers in FIG. 7, the latter being indicated by the reference number 17.

This liner 28 has a circular hole 20, for connection to the cylindrical end 13 of the flame-passage tube 10, by means of interposition of the cylindrical collar 15.

Similarly, the case 31 has an oval hole 21, for connection to the elliptical end 14 of the flame-passage tube 10, by means of interposition of the oval collar 16.

The particular shape of the body of the flame-passage tube 11 is such that, assisted by added hard, anti-wear surface deposits, it permits a drastic reduction in the relative motion, which causes wear in the corresponding anchorage collars 15, 16, which form part of the liners 28, 29.

It will be appreciated that these collars 15, 16 have also been designed with complementary geometries.

The flame-passage device 10 thus consists of a metal tube 11, which is suitably perforated in order to obtain the correct cooling of the swirl cooling type, and has an oval end 14.

The oval end 14 of the flame-passage tube 11 is provided with three rings, indicated respectively as 23, 24 and 25, for anchorage of the corresponding combustion chamber 17 to the case 31.

The flame-passage device 10 also has a free end 13, with a cylindrical shape.

Figure 10:
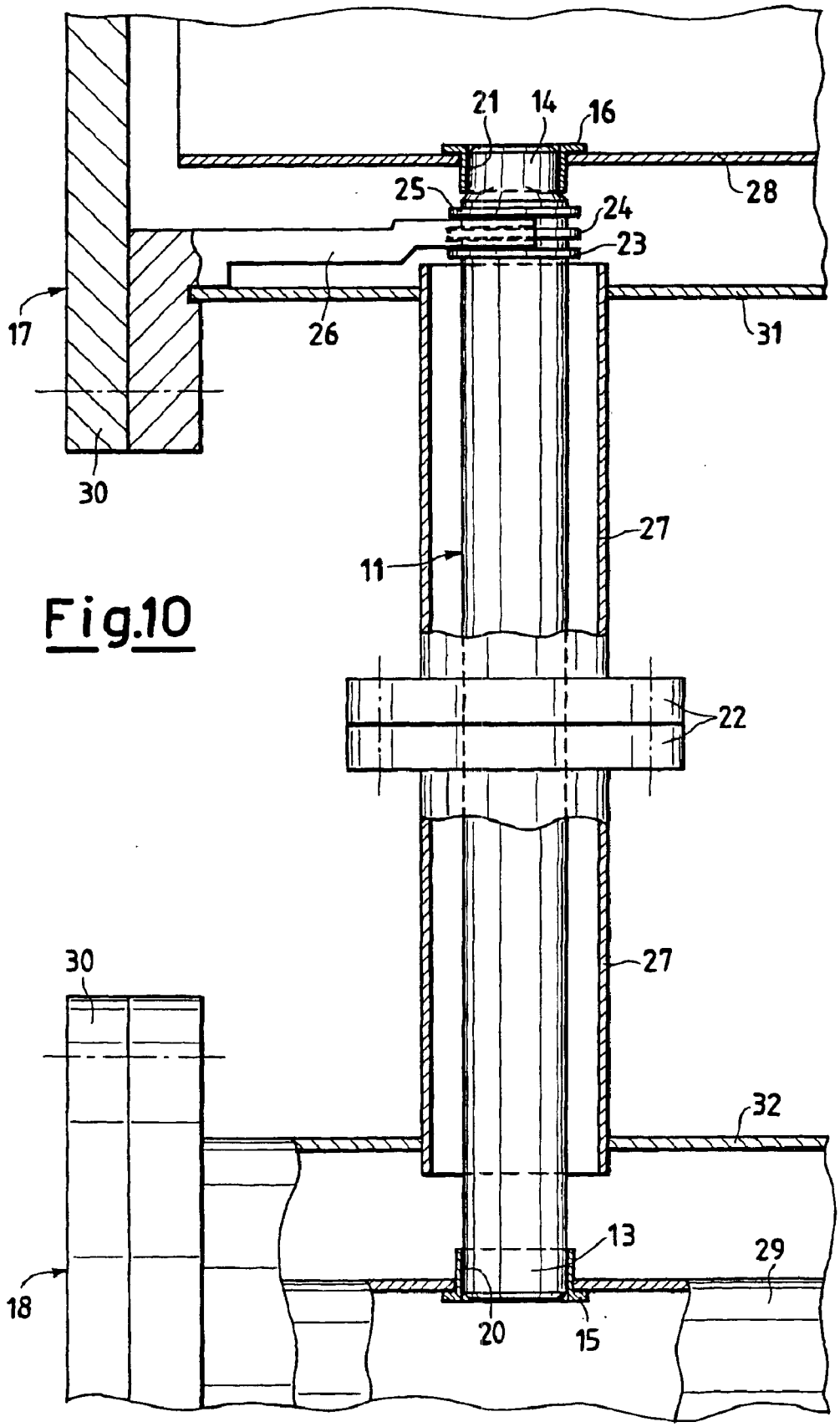
FIG. 10 represents a view partially in cross-section according to the plane X—X, of the flame-passage device for non-annular gas turbine combustion chambers, according to the present invention.

The flame-passage device 10 is anchored to the case 31 of the corresponding combustion chamber 17 by means of use of a corresponding fork 26, as illustrated in FIG. 10.

In addition, in the assembled configuration, the flame passage tube 11 is inside the flanged pipe 27.

On both the ends 13, 14 of the flame-passage tube, an anti-wear deposit made of stellite 6 or another hard material is provided, in order to cover the contact surface in the interface with the collars 15 and 16 of the liners 28, 29, which are also provided with this deposit.

The three rings 23, 24 and 25 on the oval end 14 of the flame-passage tube 11 permit anchorage of the entire flame-passage tube 11 by means of a single fork device 26, thus preventing use of the two fork devices which are necessary in the conventional embodiments.

The oval cross-section makes it possible to prevent vibratory effects, combined with the tendency to rotation induced by the swirl cooling, from triggering spin of the flame-passage tube 11 in the collars 15, 16, with consequent wear, of the type found on machines which have been overhauled.

When it is inserted in the machine, the said flame-passage tube 11 therefore connects an oval collar 16 of a liner 28, to a cylindrical collar 15 of the adjacent liner 29 (each liner 28, 29 thus has one cylindrical collar, and one oval collar, of the splash-cooled type), whereas it is connected by means of a retention fork 26 only on the oval end 14 side.

This retention fork 26 can be extracted only in the direction of the cover 30, which closes it in operative conditions.

For the removal of the combustion chamber it is thus apparent that, when the cover of one of the chambers has been removed (those which are uppermost, for example the cover 30 in FIG. 10), when the fork 26 is removed, the flame-passage tube 11 is slid inside the liner 29 of the lower chamber 18, until it abuts the rings 23, 24 and 25 on the cylindrical collar 15.

This makes it possible to release completely the flanging of the outer cases, which can then be removed easily.

The flame-passage device 10 according to the present invention thus consists altogether of:

a flame-passage tube 11, with a cylindrical end 13 and an elliptical end 14, provided with three rings 23, 24 and 25, with an anti-wear deposit both on the support surfaces of the collars 15, 16, and on those of the rings 23, 24 and 25;

a pair of collars 15, 16, one of which is cylindrical and one is oval, which are complementary to the geometries of the flame-passage tube 11, and are provided with an anti-wear deposit; and a retention fork 26, with a geometry which is suitable for anchorage to the said three rings 23, 24 and 25.

The description provided makes apparent the characteristics and advantages of the flame-passage device for non-annular gas turbine combustion chambers which is the subject of the present invention.

The following concluding comments and observations are made, in order to define the said advantages more accurately and clearly.

Firstly, in the case of the machines which use devices according to the known art, it is not possible to extract liners and the corresponding cases in successive stages.

A flame-passage tube with a new design has therefore been created, which can be extracted simply by removing the covers.

With reference to the simplification of the procedures for fitting and removal, the aim was also to meet the requirements of the overall design specification, i.e. to provide the component designed with characteristics of long service life and functional efficiency which are clearly better than those of the components known at present according to the art.

In this inventive embodiment, all the solutions presently available according to the state of the art have been implemented for the three above-described objectives (increased efficiency, longer service life of the machine, and fewer pollutant emissions), such as to obtain a unit device which includes all the advantages thus accumulated.

Since this application is designed for the aftermarket, and thus has pre-defined constraints of geometries and functional parameters, the design of the component elements, and their incorporation in the system, has led to the development of details which are innovative in terms of design and functionality.

To summarise, a flame-passage device has been provided, which makes it possible to obtain the major advantages of easy fitting and removal, as well as improved efficiency and mechanical reliability of the machine.

It is apparent that many variations can be made to the flame-passage device for non-annular gas turbine combustion chambers which is the subject of the present invention, without departing from the principles of novelty which are inherent in the inventive concept illustrated.

Finally, it is apparent that in the practical embodiment of the invention, any materials, forms and dimensions of the details illustrated can be used, according to requirements, and can be replaced by others which are equivalent from a technical point of view.

The scope of the invention is defined by the attached claims.

What is claimed is:

1. A flame-passage device for non-annular gas turbine combustion chambers, comprising:

a flanged pipe connecting cases of two successive combustion chambers;

a tubular body having a plurality of cooling holes for swirl cooling and received within said flanged pipe;

said tubular body having a first end with a cylindrical shape and a second end with an oval shape, said second oval end having three rings for anchoring one of the combustion chambers to a corresponding one of said cases.

2. A flame-passage device according to claim 1 including a cylindrical collar fitted to said first cylindrical end of the tubular body.

3. A flame-passage device according to claim 1 including an oval collar fitted to said second oval end of said tubular body.

4. A flame-passage device according to claim 1 wherein said cases house respective combustion chambers, each case having a liner with a circular hole for connection to the cylindrical end of said tubular body, and a cylindrical collar interposed between said liner and the cylindrical end of said tubular body.

5. A flame-passage device according to claim 4 wherein each case has a liner with an oval hole for connection to said oval end of said tubular body, and an oval collar interposed between said liner and said oval end of said tubular body.

6. A flame-passage device according to claim 1 including a fork engageable with the three rings at said oval end of said tubular body enabling anchorage of a corresponding combustion chamber to a case.

7. A flame-passage device according to claim 1 wherein said cases house respective combustion chambers, each case having a liner with a circular hole for connection to the cylindrical end of said tubular body, and a cylindrical collar interposed between said liner and the cylindrical end of said tubular body, each case having a liner with an oval hole for connection to said oval end of said tubular body, and an oval collar interposed between said liner and said oval end of said tubular body, an anti-wear deposit on both ends of said tubular body, said anti-wear deposit being of stellite 6 and covering contact surfaces at the interface between said collars and liners of the respective cases.

8. A flame-passage device according to claim 1 wherein each case has a liner, a collar at opposite ends of said tubular body for connecting the tubular body and liners within the cases to one another, said collars having an anti-wear deposit.

9. A flame-passage device according to claim 1 including a liner within each case, said flanged pipe, said tubular body and said liners within the cases being sized such that the flanged pipe and the tubular body are translatable along the inside of the liner body for the entire length of the flanged pipe and tubular body.

* * * * *